United States Patent [19]

Fitzgerald

[11] 4,009,820

[45] Mar. 1, 1977

[54] SHIPPING CONTAINER AND BLANK THEREFOR

[75] Inventor: Robert H. Fitzgerald, Lancaster, Pa.

[73] Assignee: Packaging Corporation of America, Evanston, Ill.

[22] Filed: Nov. 26, 1975

[21] Appl. No.: 635,760

[52] U.S. Cl. ..... 229/33; 229/34 R

[51] Int. Cl.[2] ..... B65D 5/22

[58] Field of Search ..... 229/33, 34, 38, 40

[56] References Cited

UNITED STATES PATENTS

| | | | |
|---|---|---|---|
| 2,100,644 | 11/1937 | Groves | 229/33 X |
| 2,405,499 | 8/1946 | Guyer et al. | 229/33 |
| 2,512,546 | 6/1950 | Hurndell | 229/33 X |
| 2,675,160 | 4/1954 | Buttery | 229/33 |
| 2,844,295 | 7/1958 | Williams | 229/33 |
| 2,938,623 | 5/1960 | Eichorn | 229/34 R X |
| 3,468,469 | 9/1969 | Kossoff et al. | 229/33 |
| 3,545,666 | 12/1970 | Visvydas | 229/34 R |

*Primary Examiner*—Davis T. Moorhead
*Attorney, Agent, or Firm*—Neuman, Williams, Anderson & Olson

[57] ABSTRACT

A shipping container and blank therefor are provided wherein the resulting container will have reinforced edges and corners. The blank utilizes a minimum amount of material, and when set up results in the reinforced edges and corners thereof being of multi-thicknesses of material.

3 Claims, 7 Drawing Figures

FIG. 1
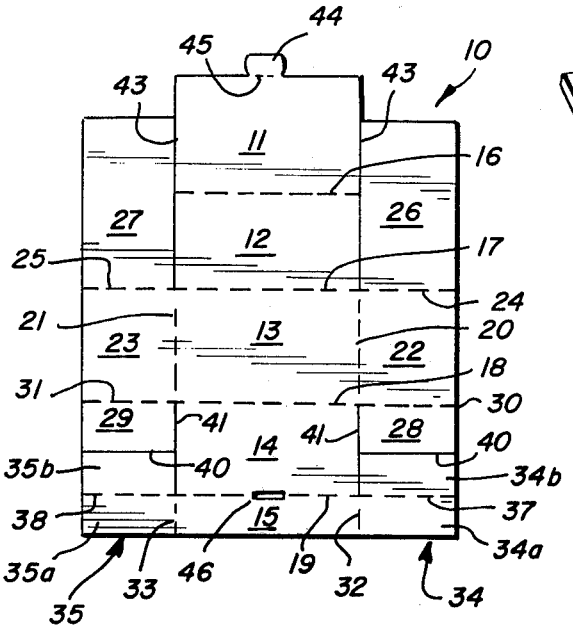
FIG. 3
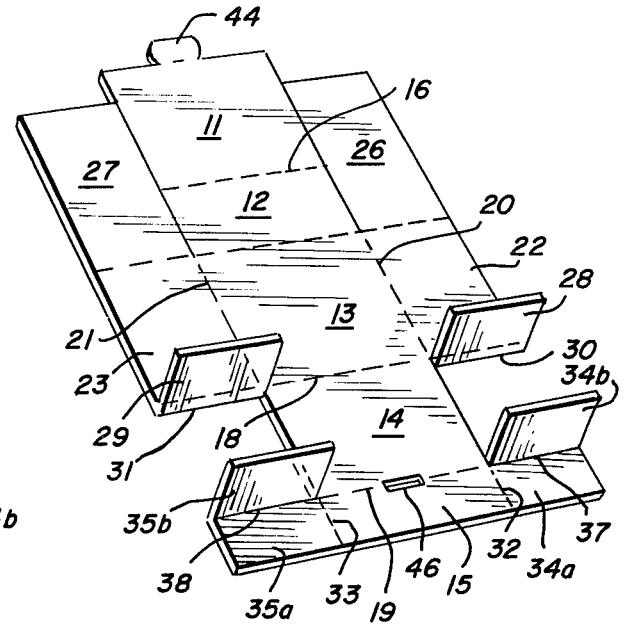
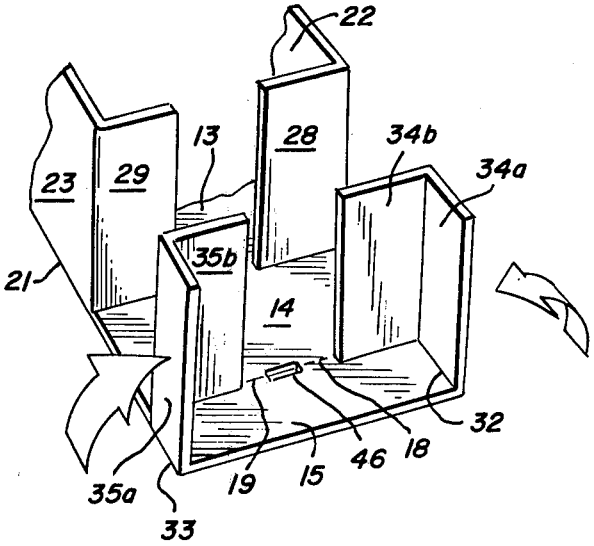
FIG. 4
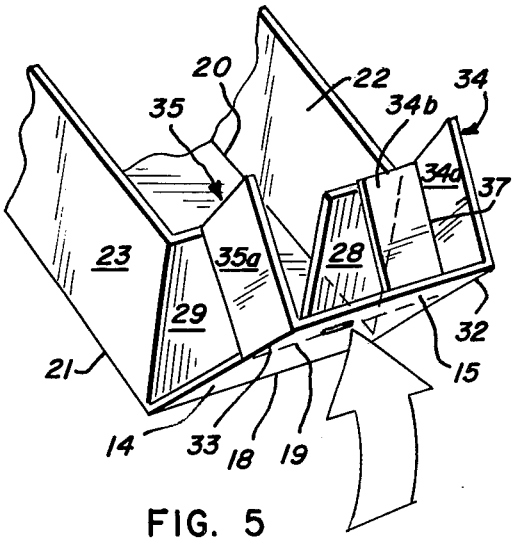
FIG. 5

FIG. 6
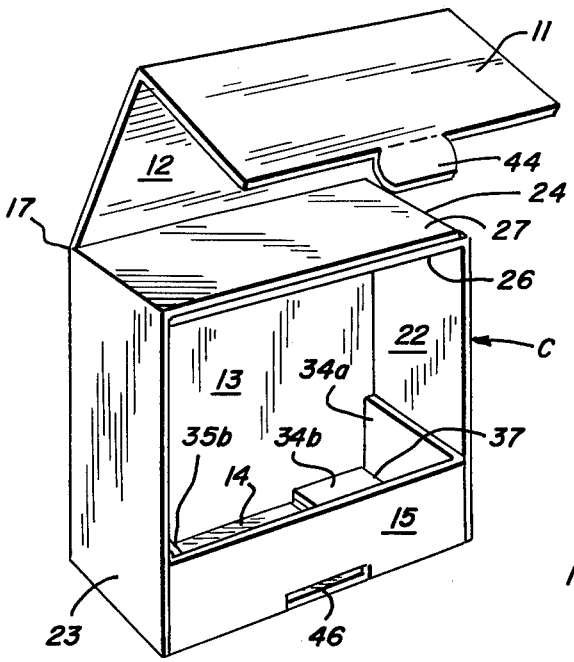
FIG. 2
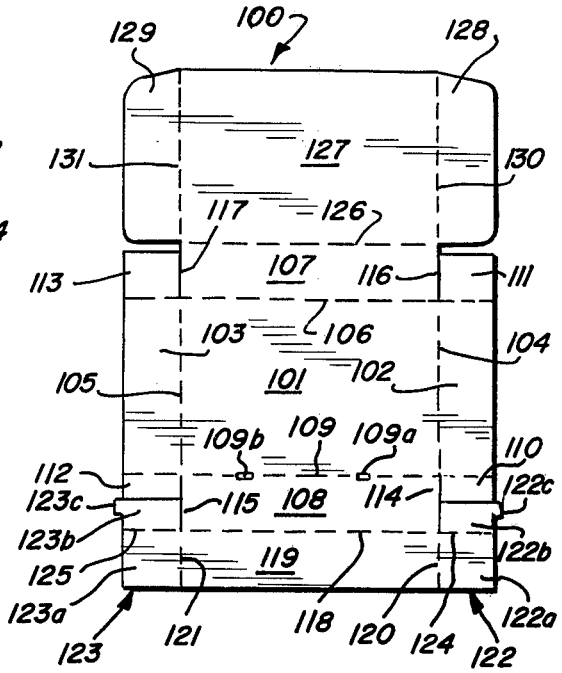
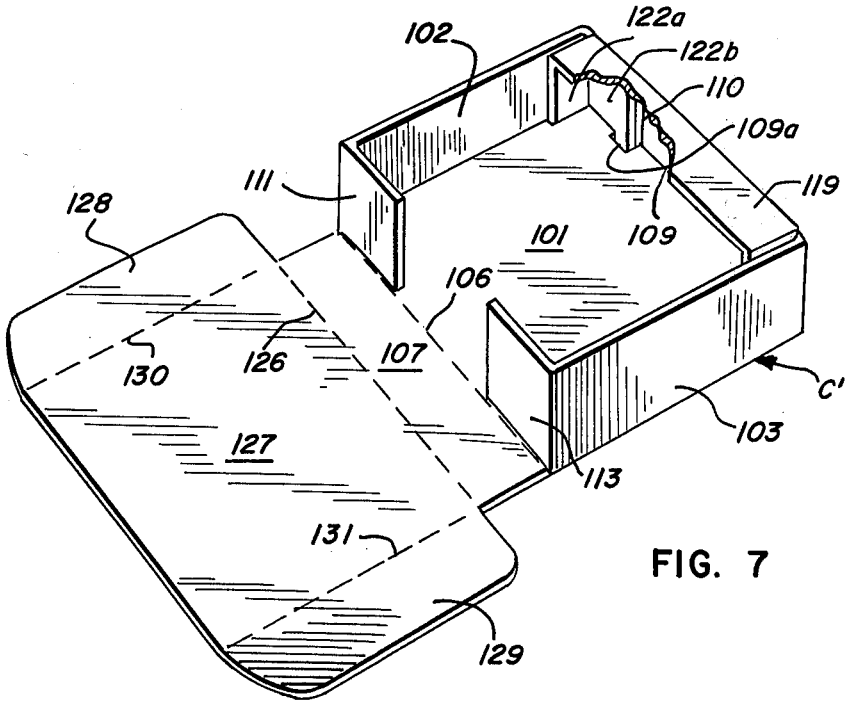
FIG. 7

SHIPPING CONTAINER AND BLANK THEREFOR

BACKGROUND OF THE INVENTION

Various containers of this general type have heretofore been designed; however because of certain design characteristics they are possessed of one or more of the following shortcomings: (1) the blank utilizes an inordinate amount of blank material; (2) the blank is of complex configuration, difficult to form, and awkward to set up; (3) the packaged article is not securely accommodated and protected within the container; and (4) it is difficult to load an article into the container.

SUMMARY OF THE INVENTION

Thus it is an object of the invention to provide a shipping container which is of simple, inexpensive construction and yet provides an effective reinforced edge and corner configuration.

It is a further object of the invention to provide a shipping container blank which may be readily formed by highspeed automatic equipment of conventional design.

It is still another object of the invention to provide a shipping container which is of compact construction, yet allows for easy loading of an article or product therein.

It is yet another object of the invention to provide a shipping container which may be closed manually or mechanically without the need for any glue pots, staplers or the like.

Another object of the invention is to provide a container wherein the article inside adds to the sturdiness of the container.

Further and additional objects will appear from the description, accompanying drawings and appended claims.

In accordance with one embodiment of the invention, a shipping container is provided for use in packaging a variety of articles such as, for example, a clock radio, a blanket or the like. The container includes an outer front panel, provided with one component of a locking means; a top panel which overlies two top flaps previously folded into overlapping relation and is foldably connected to the outer front panel; a back panel foldably connected to the opposite edge of the top panel; a base panel foldably connected to the opposite edge of the back panel; and a narrow, inner front panel foldably connected to the opposite edge of the base panel. A second component of the locking means is provided along the foldline connecting the base and inner front panels. Side panels are provided which are foldably connected to opposite edges of the back panel. A top flap is foldably connected to the upper edge of each side panel, each being of substantially the same configuration. Foldably connected to the opposite edge of each side panel is a truck flap. Extending from opposite ends of the inner front panel and disposed adjacent to the foldline between the base and inner front panel are end flaps, each comprising foldable first and second sections. Each first section is foldably attached to an end of the inner front panel and is folded substantially perpendicular thereto so as to contact the inner surface of an adjacent side panel. The second section of each end flap is foldably connected to the first section and is disposed substantially perpendicular thereto, so as to overlie the corresponding tuck flap. The second section is substantially coextensive with the underlying truck flap, thereby sandwiching the tuck flap between the base panel and the second section of the end flap.

DESCRIPTION

For a more complete understanding of the invention, reference should be made to the drawings wherein:

FIG. 1 is a plan view of a blank for one form of the improved shipping container;

FIG. 2 is a plan view of a modified blank for a second form of the improved shipping container;

FIGS. 3, 4 and 5 are perspective views of the blank of FIG. 1 shown in successive stages of set up;

FIG. 6 is a perspective view of the blank in FIG. 1 in fully set up condition but prior to being closed; and FIG. 7 is a perspective view of the blank of FIG. 2 set up for closing.

Referring now to the drawings, and more particularly to FIG. 1, a blank 10 is shown formed from a single sheet of foldable material, e.g., double-faced corrugated fibreboard, capable of being formed by automatic high-speed cutting, slotting and scoring equipment of conventional design. The blank 10 includes a front panel 11, sometimes referred to as a third panel top panel 12, sometimes referred to as a second panel; back panel 13, sometimes referred to as a first panel; base panel 14 sometimes referred to as fifth panel; and front inner panel 15, sometimes referred to as a sixth panel or reinforcing panel all of which are arranged in side-by-side relation. Foldlines 16 and 17 interconnect top panel 12 with front panel 11 and back panel 13, respectively. The opposite edge of back panel 13 is connected to base panel 14 by a foldline 18. Foldline 19 interconnects base panel 14 with front inner panel 15. Foldlines 16-19 are disposed in spaced, substantially parallel relation. Connected to opposite side edges of back panel 13 by foldlines 20 and 21 are side panels 22 and 23, sometimes referred to as fourth panels, respectively, of like configuration. Side panels 22 and 23 are joined by foldlines 24 and 25 to top or first flaps (flap members) 26 and 27, respectively. Disposed at opposite edges of side panels 22 and 23 and connected thereto by foldlines 30 and 31 are tuck flaps 28 and 29. Connected to opposite ends of front inner panel 15 along foldlines 32 and 33 are end flaps 34 and 35 of like configuration. Each end flap includes a first section **34*a* and 35*a* and a second section 34*b* and 35*b*. The sections of end flaps 34 and 35 are connected to one another by foldlines 37 and 38, respectively, see FIG. 1**.

Blank 10 is cut so as to minimize any material waste, as exemplified by cuts or slots 40 and 41 which define peripheral portions of tuck flap 28 or 29, end flap sections 34b or 35b and base panel 14. Likewise, cuts 43 define the corresponding side edges of top flaps 26 and 27, top panel 12 and front panel 11. Thereby, not only is waste material minimized, but the blank 10 has a simple configuration.

Front panel 11 includes a locking tab 44, which is adapted to fold about foldline 45. The tab is sized so as to extend through an interlock with a slot 46 formed in the foldline 19, when the container is fully set up.

Referring now to FIGS. 3–6, the successive steps to be followed in setting up the shipping container C are shown. Initially, the tuck flaps 28 and 29 and the end flap sections **34*b* and 35*b* are folded to upright positions along foldlines 30, 31 and 37, 38 whereby tuck flap 28 and flap section 34*b* and tuck flap 29 and flap section 35*b*** are disposed in spaced parallel relation.

After the flaps and flap sections have assumed the positions shown in FIG. 3, flap sections 34*a* and 35*a* are then folded to upright positions along foldlines 32 and 33, respectively, as shown in FIG. 4. It will be noted that the sections 34*a*–34*b* or 35*a*–35*b* of each end flap are disposed at substantially right angles to one another. Simultaneously with the folding of the flap sections 34*a* and 35*a*, the side panels 22, 23 are folded upright relative to back panel 13 along foldlines 20 and 21, respectively. Once the side panels 22 and 23 are in upright positions, tuck flaps 28 and 29 extend inwardly towards one another. In a like manner, flap sections 34b and 35b also extend inwardly towards one another. Base panel 14 with the front inner panel 15 attached thereto and the end flaps 34, 35 attached to panel 15 are folded as a unit about foldline 18 to an upright position whereby the end flaps 34, 35 will extend over the upper edge of the truck flaps 28, 29 and into the interior compartment of the container C, see FIG. 5. Once the base panel 14 has assumed its upright position, the end flaps are then folded downwardly causing the tuck flaps to be captured between the inner surface of the base panel and the respective end flaps. It should be noted that when the tuck flaps engage the surface of base panel 14, they will span the distance between the back panel 13 and the front inner panel 15.

Once the front inner panel and end flaps have assumed the positions shown in FIG. 6, the container C is placed on a support with the base panel 14 resting thereon and while in such position is in condition for loading. When the product is placed in the compartment, it will rest upon the flap sections 34b and 35b and the sides of the product will engage the flap sections 34a, 35a. The front and back surfaces of the product will also engage the inner surfaces of the front inner panel 15 and back panel 13, respectively. After the product has been loaded into the container C, the top flaps 26, 27 are folded toward one another so as to overlie the top surface of the product, see FIG. 6. The top panel 12 is then folded about foldline 17 so as to overlie the previously folded top flaps 26, 27. Front panel 11 will assume an overlying relation with the front inner panel 15 whereby locking tab 44 may be inserted into slot 46 and thereby retain the top and front panels in their proper folded relation.

It should be noted that when the container C is set up and loaded, the bottom of the product, particularly at the side corners, will be protected by mult-thicknesses of the blank material. The same is true of the front, top and sides of the product. Container C enables the front panel 11 and the top panel 12 to be opened, as shown in FIG. 6, whereby a substantial portion of the front exterior of the accommodated product may be observed without being removed from the container.

A second form of the improved container C′ is shown in FIG. 7. This embodiment is similar to container C except that container C′ is a top opening style, particularly suitable for accommodating blankets, clothing items, etc. The blank 100 for container C′ is shown in FIG. 2 and includes a bottom or base panel 101 having a pair of side panels 102 and 103 connected, respectively, by foldlines 104 and 105 to opposite sides thereof. Connected to the panel 101 by foldline 106, which is disposed transverse to foldlines 104 and 105 interconnects coresponding ends thereof, is a back panel 107. A front panel 108 having substantially the same configuration as back panel 107 is connected to the front edge of panel 101 by a foldline 109. Foldline 109 is interrupted by a pair of longitudinally spaced slots 109a and 109b. When blank 100 is set up, side panels 102, 103 and back and front panels 107, 108 assume upright positions relative to bottom panel 101 and cooperate therewith and with one another to form a compartment for accommodating a product.

Attached to opposite ends of side panels 102, 103 are tuck flaps 110, 111 and 112, 113. Tuck flaps 110, 112 are separated from opposite ends of front panel 108 by portions of T-shaped slits or cuts 114 and 115. Tuck flaps 111, 113 are also separated from opposite ends of the back panel 107 by a pair of sits or cuts 116, 117. Slit 116 and slit portion 114 are in alignment wth foldline 104, and in a like manner slit 117 and slit portion 115 are in alignment with foldline 105.

Connected by foldline 118 to the edge of the front panel 108, which ultimately becomes the upper edge of the set up container C′, is a relatively narrow inner top panel 119. Panel 119 assumes an overlying spaced relation with respect to the bottom panel 101 when the container C′ is set up, as seen more clearly in FIG. 6. Connected by foldlines 120, 121 to opposite ends of inner top panel 119 are end flaps 122, 123, respectively. As in the case of container C, end flaps 122, 123 are of like configuration and each comprises sections 122*a*, 122*b* and 123*a*, 123*b*. Sections 122*a*, 122*b* are connected together by a foldline 124 which is aligned with foldline 118. Similarly, sections 123*a*, 123*b* are connected together by a foldline 125 which is aligned with the opposite end of foldline 118. Flap section 122*b* is separated from tuck flap 110 and an end of front panel 108 by the T-shaped slit 114. Flap section 123b, on the other hand, is separated from tuck flap 112 and the opposite end of front panel 108 by the T-shaped slit 115.

Connected by foldline 126 to what ultimately becomes the upper edge of back panel 107 is a top panel 127. A pair of second side panels 128, 129 are connected by foldlines 130, 131 to opposite sides of outer top panel 127.

Side panels 128, 129 are normally adapted to be disposed inwardly of respective side panels 102, 103 when the container C′ is set up and the outer top panel 127 assumes its overlying closed position.

In setting up container C′, tuck flaps 110, 112 and flaps sections 122*b*, 123*b* are folded so as to assume upright positions relative to the remainder of the blank 100. End flaps 122, 123 are then folded to upright positions about foldlines 120, 121. Side panels 102, 103 are also folded to upright positions about foldlines 104, 105. Once the side panels 102, 103 are in upright positions relative to the bottom panel 101 and tuck flaps 110, 112 are facing inwardly towards one another, front panel 108 along with inner top panel 119 and prefolded end flaps 122, 123, are folded as a unit about foldline 109 until front panel 108 assumes an upright position relative to bottom panel 101. Inner top panel 119 and the prefolded end flaps 122, 123 are then folded as a unit about foldline 118 until panel 119 assumes an overlying, spaced, substantially parallel relation with respect to bottom panel 101. Simultaneously, with panel 119 assuming the overlying spaced position with respect to panel 101, the respective prefolded end flaps 122, 123 will cause tuck flaps 110, 112 to be sandwiched or captured between flap sections 122*b* and the inside surface of front panel 108, and between flap section 123*b* and the inside surface of said front panel. It should be noted that flap sections 122*b* and 123*b* are provided with peripheral tabs 122*b* and 123*c* which are adapted to interlockingly engage slots 109*a* and 109*b*, Thus, the interlocking tabs and slots positively retain the side panels 102, 103, front panel 108, and inner front panel 119 in their proper set-up positions. As seen in FIG. 6, the end flaps 122, 123 and the corresponding tuck flaps 110, 112 provide strong reinforced corners for the container C'.

In lieu of the tabs 122*c*, 123*c*, the size of the flap sections 122*b*, 123*b* relative to the height of the front panel 108 may be such that the flap sections 122b, 123b will be frictionally wedged between the adjacent upper surface of the bottom panel 101 and the inner top panel 119.

Once the end flaps 122, 123 and the front and inner top panels 108, 119 are in their proper set-up positions, the partially set up container C' is then loaded with the product, and tuck flaps 111, 113 are folded inwardly towards one another. The back panel 107 and the top panel 127 associated therewith are then folded as a unit about foldline 106 until the back panel assumes an upright position relative to the bottom panel 101. The side panels 128, 129 are folded at right angles relative to panel 127, so that as the latter is folded about foldline 126 to an overlying closed position, the side panels 128, 129 will extend into the product compartment and slidably and frictionally engage the inside surface of side panels 102, 103, respectively.

If desired, the front edge of outer top panel 127 may be provided with one or more locking tabs, not shown, but similar to tab 44 of container c, which would interlock with corresponding slots, not shown, formed in foldline 118.

It should be noted when container C' is fully set up and the top panel is in its closed position, the four upright corners defining the compartment in which the product is placed are reinforced with multi-thicknesses of the blank material. In addition, the sides and portions of the top of the container C' are of multi-thicknesses of material thereby resulting in a significantly stronger container without substantially increasing the size of the blank.

Thus, it will be noted that in either form of the illustrated containers, the blank therefor is of simple configuration which may be readily formed on conventional high speed cutting, slotting and scoring equipment. Furthermore, the blank in either instance produces a minimal amount of waste material and may be readily set up manually or with automatic or semi-automatic folding equipment. The improved containers are provided with effective reinforced corners thereby providing greater protection for the accommodated product. In addition, the accommodated product may be observed without having to be removed from either form of container.

The size and shape of the blank and resulting container may be further varied from that shown without departing from the scope of the invention.

I claim:

1. A shipping container for a product being formed from a single blank of foldable sheet materal comprising a first panel forming a first surface portion of a product accommodating compartment when the container is closed, a pair of flap members being folded towards one another and forming a second surface portion of the compartment, when the container is closed, and being in unfolded relation, when the container is opened for loading or unloading the product accommodating compartment, a second panel overlaying said flap members only when the latter are folded towards one another and when the container is closed, a third panel connected to said second panel and folded relative thereto and forming a third surface of the compartment, a pair of fourth panels connected to said third panel and folded relative thereto and forming fourth surface portions of the compartment, said flap members being foldably connected to corresponding fourth panels and extending angularly therefrom, a fifth panel forming a fifth surface portion of the compartment, and a reinforced edge and corner construction for the compartment; said construction including a reinforcing panel foldably connected to and extending angularly from the fifth panel, end flaps foldably connected to and extending angularly from opposite ends of said reinforcing panel, each end flap having a first section foldably connected to an end of said reinforcing panel and engaging the compartment-forming surface portion of one fourth panel, and an angularly extending second section foldably connected to said first section, and tuck flaps foldably connected to corresponding ends of the fourth panels and extending angularly therefrom, said tuck flaps being sandwiched between the fifth panel and the second sections of said end flaps, when the container is either opened or closed.

2. This shipping container in claim 1 wherein said reinforcing panel is disposed in a plane transverse to the plane of the fifth panel and extends therefrom less their the distance between the fifth panel and the flap members.

3. A blank of foldable sheet material for use in forming a shipping container having reinforced edge and corner portions; said blank comprising a first panel for disposition adjacent one exterior surface of the product to be accommodated within the container; a second panel having a side thereof foldably connected to said first panel; a third panel for disposition adjacent a second exterior surface of the accommodated product, said third panel having a side thereof foldably connected to the opposite side of said second panel, said first and third panels being of substantially like configuration; fourth panels for disposition adjacent third exterior surfaces of the accommodated product, said fourth panels being foldably connected to opposite sides of said first panel; first flaps foldably connected to corresponding ends of said fourth panels; tuck flaps foldably connected to the opposite ends of said fourth panels, a fifth panel for disposition adjacent a fourth exterior surface of the accommodated product, said fifth panel being foldably connected to said first panel and disposed at a side thereof opposite said second panel, said fifth and second panels being of substantially like configuration; a sixth panel for disposition adjacent the second exterior surface of the accommodated product, said sixth panel being foldably connected to said fifth panel, said sixth panel having a dimension measured transversely of the folding connection less than the corresponding dimension of said third panel; end flaps, each including an elongated first section foldably connected to an end of said sixth panel for disposition adjacent the third exterior surface of the accommodated product, and an elongated second section foldably connected to said first section for disposition adjacent the second exterior surface of the accommodated product, each elongated section having a longitudinally dimension substantially the same as the spacing between said first and sixth panels.

* * * * *

UNITED STATES PATENT AND TRADEMARK OFFICE

CERTIFICATE OF CORRECTION

PATENT NO. : 4,009,820

DATED : MARCH 1, 1977

INVENTOR(S) : ROBERT H. FITZGERALD

It is certified that error appears in the above-identified patent and that said Letters Patent are hereby corrected as shown below:

Column 3, line 18 - "truck" should be --tuck--

Column 4, line 12 - "sits" should be --slit--

Column 5, line 1 - "122b" should be --122c--
line 3 - "109b," should be --109b, respectively--
line 27 - "surface" should be --surfaces--
line 31 - "c" should be --C--

Claim 1, Column 6, line 5 - "third surface" should be --third surface portion--

Claim 2, Column 6, line 30 - "their" should be --than--
line 34 - "of the" should be --of a--

Signed and Sealed this

Seventeenth Day of May 1977

[SEAL]

*Attest:*

RUTH C. MASON
*Attesting Officer*

C. MARSHALL DANN
*Commissioner of Patents and Trademarks*